US007001135B2

(12) United States Patent
Shimokakiuchi et al.

(10) Patent No.: US 7,001,135 B2
(45) Date of Patent: Feb. 21, 2006

(54) CONSTRUCTION MACHINE

(75) Inventors: Hiroshi Shimokakiuchi, Hiroshima (JP); Hiroshi Morita, Hiroshima (JP); Shintaro Sakitani, Hiroshima (JP); Kenta Kojima, Hiroshima (JP); Yoshiyasu Umezu, Hiroshima (JP); Takayuki Okunishi, Hiroshima (JP); Kiyokazu Tanaka, Hiroshima (JP); Yukio Hiraoka, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 10/755,234

(22) Filed: Jan. 13, 2004

(65) Prior Publication Data

US 2004/0163865 A1 Aug. 26, 2004

(30) Foreign Application Priority Data

Feb. 20, 2003 (JP) ..... 2003-043160

(51) Int. Cl.
*E02F 5/02* (2006.01)

(52) U.S. Cl. ..... 414/687; 180/89.12; 296/102; 414/694

(58) Field of Classification Search ..... 414/687, 414/694; 180/89.12; 296/102
See application file for complete search history.

(56) References Cited

U.S. PATENT DOCUMENTS 2,911,232 A * 11/1959 Hastings, Jr. et al. ..... 296/102
5,108,253 A * 4/1992 Kobayashi et al. ..... 414/694
5,842,732 A * 12/1998 Daggett et al. ..... 296/102

FOREIGN PATENT DOCUMENTS

| | | |
|---|---|---|
| JP | 2-42963 | 3/1990 |
| JP | 2-308019 | 12/1990 |
| JP | 4-49583 | 4/1992 |
| JP | 10-219740 | 8/1998 |
| JP | 11-107318 | 4/1999 |
| JP | 2000-273909 | 10/2000 |
| JP | 2000-282511 | 10/2000 |
| JP | 2001-11898 | 1/2001 |
| JP | 2001-26944 | 1/2001 |
| JP | 2001-81809 | 3/2001 |
| JP | 2001-180412 | 7/2001 |
| JP | 2001-279718 | 10/2001 |
| JP | 2001-303618 | 10/2001 |

* cited by examiner

*Primary Examiner*—Donald W. Underwood
(74) *Attorney, Agent, or Firm*—Oblon, Spivak, McClelland, Maier & Neustadt, P.C.

(57) ABSTRACT

In a construction machine having a working attachment, an operator's seat disposed on one side of a machine body, a devices receptacle portion disposed on the other side, and an operating member disposed sideways of the seat for operating the attachment, the machine is characterized in that a canopy comprises a front support post disposed in front of the seat, a rear support post disposed behind the seat, a side support post disposed sideways of the seat and on the side where an operator gets on and off the machine body, and a roof which connects the support posts with one another, the front support post being disposed close to the devices receptacle portion and the side support post being disposed outside the operating member to form an open portion obliquely in front of the seat where open portion is for ensuring a working vision for the attachment which is swung to the seat side.

8 Claims, 4 Drawing Sheets

CONSTRUCTION MACHINE

BACKGROUND OF THE INVENTION

1. Field of the Invention

The present invention relates to a construction machine having a canopy structure.

2. Description of the Related Art

There is known a hydraulic excavator having a canopy of TOPS (Tip-Over Protection Structure) which intends to protect an operator supported by a seat belt in the event a machine body of the excavator should turn sideways (see, for example, Japanese Patent Laid Open Publication No. 2001-303618).

The canopy is usually constructed of four support posts arranged around an operator, with a roof being mounted on upper ends of the support posts. In an excavator provided with a boom as a front attachment, an upper rotating body is rotated to the right, while the boom is swung to the left, and in this state there is performed an excavating work for ditch. This is because of an advantage such that, with the left swing motion of the boom, the front attachment can be drawn near the operator during the work.

However, there is the problem that the support post disposed in a left front position obstructs the operator's vision in the excavating work.

Particularly in a compact excavator constructed such that a swing radius of a rear end of the upper rotating body is received within the width of the excavator, the space on the front side of an operator's seat is apt to become narrow and the support post disposed in the left front position oppresses the space of the operator's seat. Besides, with this support post, the width of the operator's getting-on/off range is extremely limited, thus giving rise to the problem that it becomes difficult for the operator to get on and off the machine body.

SUMMARY OF THE INVENTION

It is an object of the present invention to provide a construction machine having a swing boom and a canopy structure capable of ensuring a required working visibility of the construction machine and ensuring easiness of getting on and off the machine body while satisfying the specification of TOPS.

The construction machine of the present invention has the following basic construction.

The construction machine of the present invention comprises a lower traveling body, an upper rotating body mounted rotatably on the lower traveling body, a working attachment as front attachment attached to a front portion of the upper rotating body so as to be swingable in a transverse direction of a machine body, an operator's seat provided on one side of the upper rotating body in the transverse direction of the machine body, a devices receptacle portion provided on the other side of the upper rotating body in the transverse direction of the machine body, an operating member for operating the working attachment, the operating member being provided sideways of the operator's seat, and a canopy formed around the operator's seat. The upper rotating body is disposed in such a manner that a swing radius of a rear end thereof is substantially received within the width of the lower traveling body.

The canopy comprises a front support post disposed in front of the operator's seat, a rear support post disposed behind the operator's seat, a side support post disposed sideways of the operator's seat and on the side where an operator gets on and off the machine body, and a roof member adapted to connect the support posts with one another and constitute a rigid body. Further, the front support post is disposed close to the devices receptacle portion and the side support post is disposed outside the operating member in such a manner that an open portion for keeping in substantially full view of said working attachment which is swung to the operator's seat side is formed obliquely in front of said operator's seat.

For example, when an excavating work for ditch is carried out while swinging the working attachment to the operator's seat side, since the aforesaid open portion is formed obliquely in front (left front) of the operator's seat, a required working visibility or a working sight for the working attachment is improved and, furthermore, it becomes easier for an operator to get on and off the machine body.

BRIEF DESCRIPTION OF THE DRAWINGS

FIGS. 2A to 2C illustrate support posts of the canopy in the first embodiment, of which FIG. 2A is a front view, FIG. 2B is a side view, and FIG. 2C is a plan view;

FIGS. 3A to 3C illustrate a roof of the canopy in the first embodiment, of which FIG. 3A is a front view, FIG. 3B is a plan view, and FIG. 3C is a side view.

DESCRIPTION OF THE PREFERRED EMBODIMENTS

Canopy structures in a construction machine embodying the present invention will be described below with reference to FIGS. 1 to 4 in illustration of, not in limitation of, the present invention.

Figure 1:
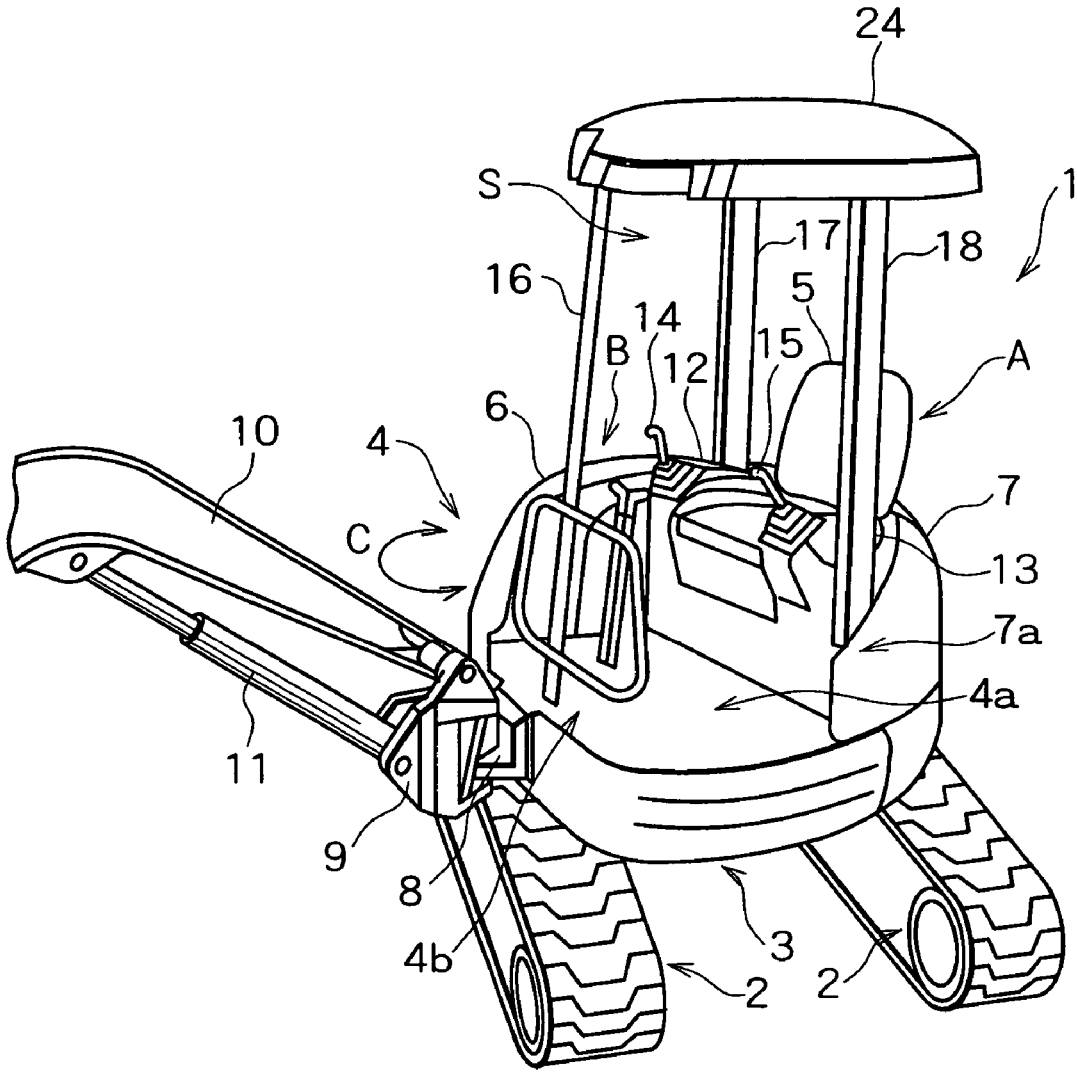
FIG. 1 is a perspective view showing a canopy structure according to a first embodiment of the present invention.

FIG. 1 illustrates a small-sized excavator, alias compact excavator, provided with a canopy instead of cabin, as a construction machine according to the present invention.

The excavator (compact excavator) 1 illustrated in the same figure comprises a lower traveling body 3 having a pair of crawlers 2 and an upper rotating body 4 mounted rotatably on the lower traveling body. The excavator 1 is a rear small-swing type constructed such that the swing radius of a rear end of the upper rotating body is received within the width of the excavator (excavator with short tail swing radius, with zero tail swing overhang from crawlers, or with no overhang tail from crawlers while swing can be made the most of when used in a work site).

A swing bracket portion is provided on a front side of the upper rotating body 4 and a base portion of a boom (swing boom) is connected to the swing bracket portion to effect a swing motion of an entire front attachment (working attachment). An excavating work for ditch is carried out in a state in which the upper rotating body is swung to the right and the boom swung in the opposite direction (left side).

On the left-hand side of a swing frame or a rotating frame of the upper rotating body 4, there is ensured an operation space A for disposing an operation device and an operator's seat 5 therein. On the right-hand side of the space A, there is ensured a devices space B for receiving therein hydraulic devices and tanks such as a hydraulic oil tank. The numeral 6 denotes a devices cover as a devices receptacle portion which covers devices, and numeral 7 denotes an engine cover disposed behind the operator's seat to cover an engine.

A connecting bracket 8 projects from the front portion of the swing frame, and a swing bracket 9 is connected to the bracket 8 so as to be rotatable about a vertical shaft.

A base end portion of a boom 10 which constitutes the front attachment is connected to the swing bracket 9. The boom 10 can be raised and lowered by extending and retracting a boom cylinder 11.

The swing bracket 9 swings in the direction of arrow C by extension and retraction of a swing cylinder (not shown) which is provided behind the swing bracket 9.

Control boxes 12 and 13 are provided on both sides of a seat of the operator's seat 5 which is installed in the operation space A. Operating levers 14 and 15 as operating members are provided at front end portions respectively of the control boxes 12 and 13.

In a surrounding relation to the operator's seat, a front support post 16 is disposed at a front position on the right-hand side of the operator's seat 5 (on the devices cover 6 side), a rear support post 17 is disposed at a rear position on the right-hand side of the operator's seat, and a side support post 18 is disposed on the left-hand side of the operator's seat (on the operator's getting on/off side).

Figure 2C:
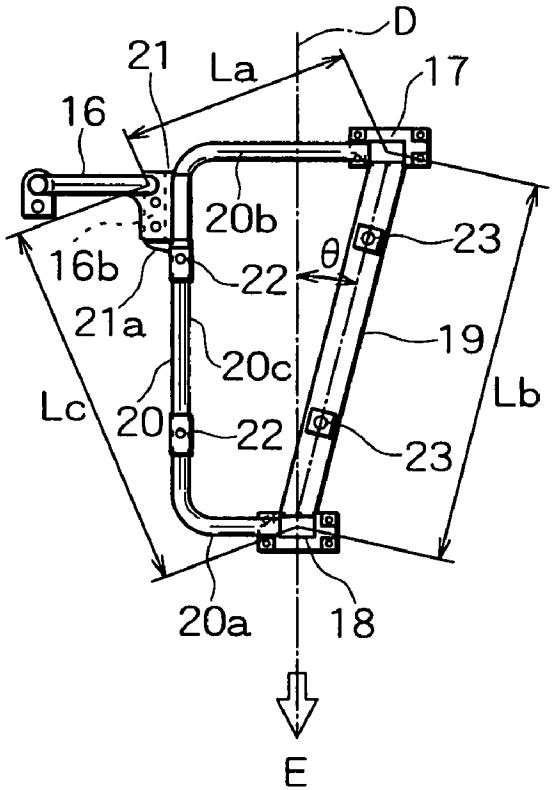
Figure 2B:
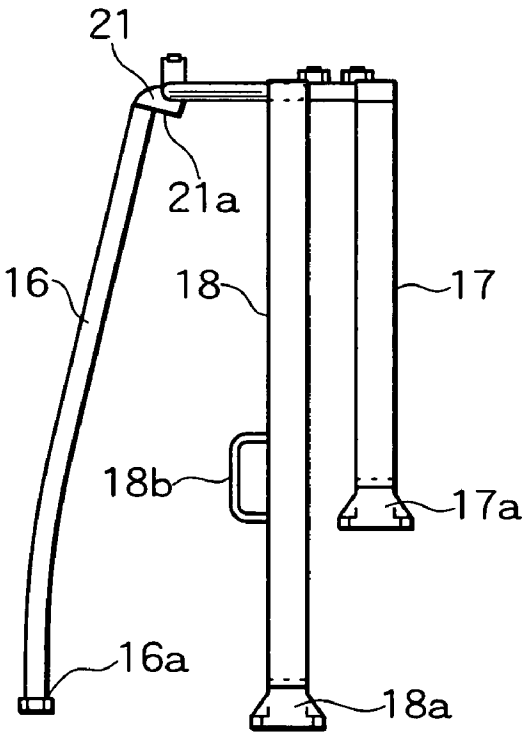
Figure 2A:
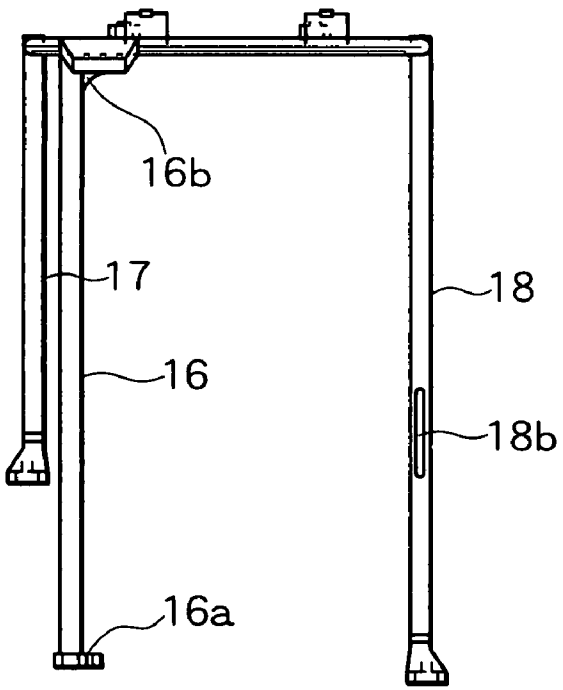

FIGS. 2A to 2C illustrate the construction of the support posts, of which FIG. 2A is a front view, FIG. 2B is a side view, and FIG. 2C is a plan view.

As shown in FIGS. 2A and 2B, the front support post 16 is constituted by a round pipe formed by molding in a backwards inclined state, and a fixing plate 16*a* is provided at a lower end of the round pipe. The fixing plate 16*a* is fixed with bolts to a front edge portion 4*b* (see FIG. 1) of a floor plate 4*a*.

The rear support post 17 is constituted by a rectangular pipe having a substantially rectangular section, and a bracket 17*a* is provided at a lower end of the rectangular pipe. The bracket 17*a* is fixed to a mounting stay (not shown) disposed on the operator's side of the devices cover 6.

The side support post 18 is also constituted by a rectangular pipe having a substantially rectangular section, and a bracket 18*a* is provided at a lower end of the square pipe. The bracket 18*a* is fixed through a mounting stay (not shown) onto the swing frame at a position corresponding to a left front portion 7*a* of the engine cover 7. At an approximately intermediate portion in the vertical direction of the side support post 18, there is provided a handle 18*b* to be grasped by an operator when the operator gets on or off the machine body.

Next, a description will be given below of an upper structure of each of the support posts 16 to 18.

As shown in FIG. 2C, a rear connecting member 19 constituted by a rectangular pipe (rectangular steel pipe) having a substantially rectangular section is mounted bridgewise at upper end portions of the rear support post 17 and the side support post 18. The rear connecting member 19 is inclined (backwards in the figure) at an angle θ relative to an imaginary line D which extends in the transverse direction of the machine body when seen in plan or in a plan view thereof, and is disposed so as to cross over an operator's head, thereby protecting the operator against falling goods from above.

Thus, the rear and side support posts are each constituted by a rectangular steel pipe of a substantially rectangular section and are disposed so that their long sides lie in the longitudinal direction, whereby not only the rigidity of the canopy can be enhanced but also, in the event the machine body should turn sideways, an operator can surely be protected by vertically extending wide faces of both support posts.

The rear and side support posts 17, 18 are further interconnected by a front connecting member 20.

The front connecting member 20 is formed by a round pipe which is forwardly U-shaped by molding, and comprises generally parallel arm portions 20*a* and 20*b* in the longitudinal direction and a front beam portion 20*c* disposed in the transverse direction of the machine body.

By thus connecting the upper ends of the rear and side support posts through the front connecting member 20 which is forwardly U-shaped in plan (when seen in plan), not only the rigidity of the upper end portions of the support posts can be further enhanced, but also the front portion of the roof can be fixed stably.

A bracket 21 having a mounting plate portion 21*a* is fixed to a right end portion of the front beam portion 20*c*. Correspondingly to the mounting plate portion 21*a*, a mounting plate portion 16*b* is fixed to an upper end of the front support post 16. By superimposing the mounting plate portions 21*a* and 16*b* one on the other and clamping the two with bolts, the front connecting member 20 and the front support post 16 are connected with each other.

Given that the distance between an upper end center of the front support post 16 and that of the rear support post 17 is La, the distance between the upper end center of the rear support post 17 and an upper end center of the side support post 18 is Lb, and the distance between the upper end center of the side support post 18 and that of the front support post 16 is Lc, the support posts 16 to 18 are arranged so as to satisfy the relations of La<Lb and La<Lc.

By arranging the support posts 16 to 18 so as to meet the above relations, even in the event the machine body should turn sideways in the direction of arrow E, a load imposed on the side support post 18*a* can be dispersed effectively to both rear support post 17 and front support post 16 through the rear and front connecting members 19, 20, whereby the support posts 16 to 18 are prevented from being heavily deformed or damaged.

Further, the side support post 18 is positioned near the operating lever 15. Therefore, when an operator's hand is released from the operating lever 15, the operator can put his or her hand on the nearby side support post 18 quickly without compulsion. Besides, since the side support post 18 is positioned sideways of the operator when sitting on the operator's seat 5, the operator can brace while putting his or her hand on the side support post, not hanging from the post. Consequently, it is possible to prevent the operator from jumping out of the canopy under violent rolling or the like.

Further, the front support post 16 is disposed close to the devices cover 6 and the side support post 18 is disposed outside the operating lever 15. Consequently, an open portion or an open space S for keeping in substantially full view of the front attachment at an excavating work is formed obliquely in front of the operator's seat, whereby the working sight or an operator's vision at an excavating work becomes wider. For example, even when an excavating work for ditch is carried out with the front attachment swung to the operator's side, the working sight is not obstructed and therefore it becomes easier to perform the work. Besides, in the rear small swing type compact excavator 1, the space in front the operator's seat 5 is apt to be narrow, but a sense of oppression can be eliminated because there is no support post on the left front side.

Numeral 22 denotes a roof fixing piece provided on an upper surface of the front connecting member 20 and having an internally threaded portion, and numeral 23 denotes a roof fixing piece provided on an upper surface of the rear connecting member 19 and also having an internally threaded portion.

Figure 3A:
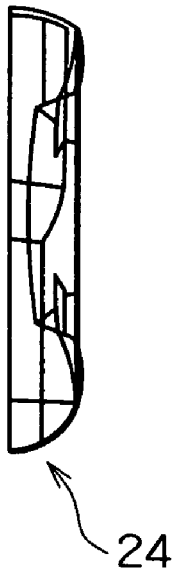
Figure 3B:
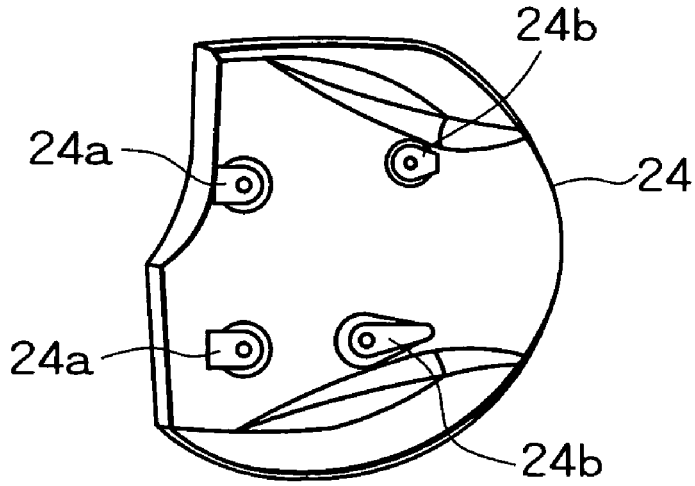
Figure 3C:
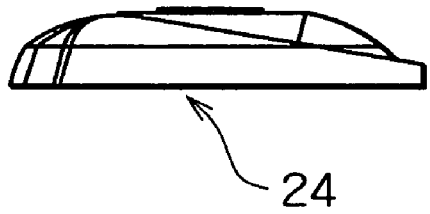

A roof 24 formed as a roof member by resin-molding, which is shown in FIGS. 3A to 3C, is mounted to the roof fixing pieces.

FIGS. 3A, 3B, and 3C are a front view, a plan view, and a side view, respectively, of the roof 24.

In the roof 24, there are formed a pair of fixing holes or holes for fixing 24*a* correspondingly to the arrangement of the roof fixing pieces 22 and a pair of fixing holes 24*b* correspondingly to the arrangement of the roof fixing pieces 23. Bolts are inserted respectively through the fixing holes 24*a* and 24*b* and are then engaged threadedly with the internally threaded portions of the roof fixing pieces 22 and 23, whereby the roof 24 is fixed while being supported by both front connecting member 20 and rear connecting member 19 and there is constituted a rigid canopy.

Figure 4:
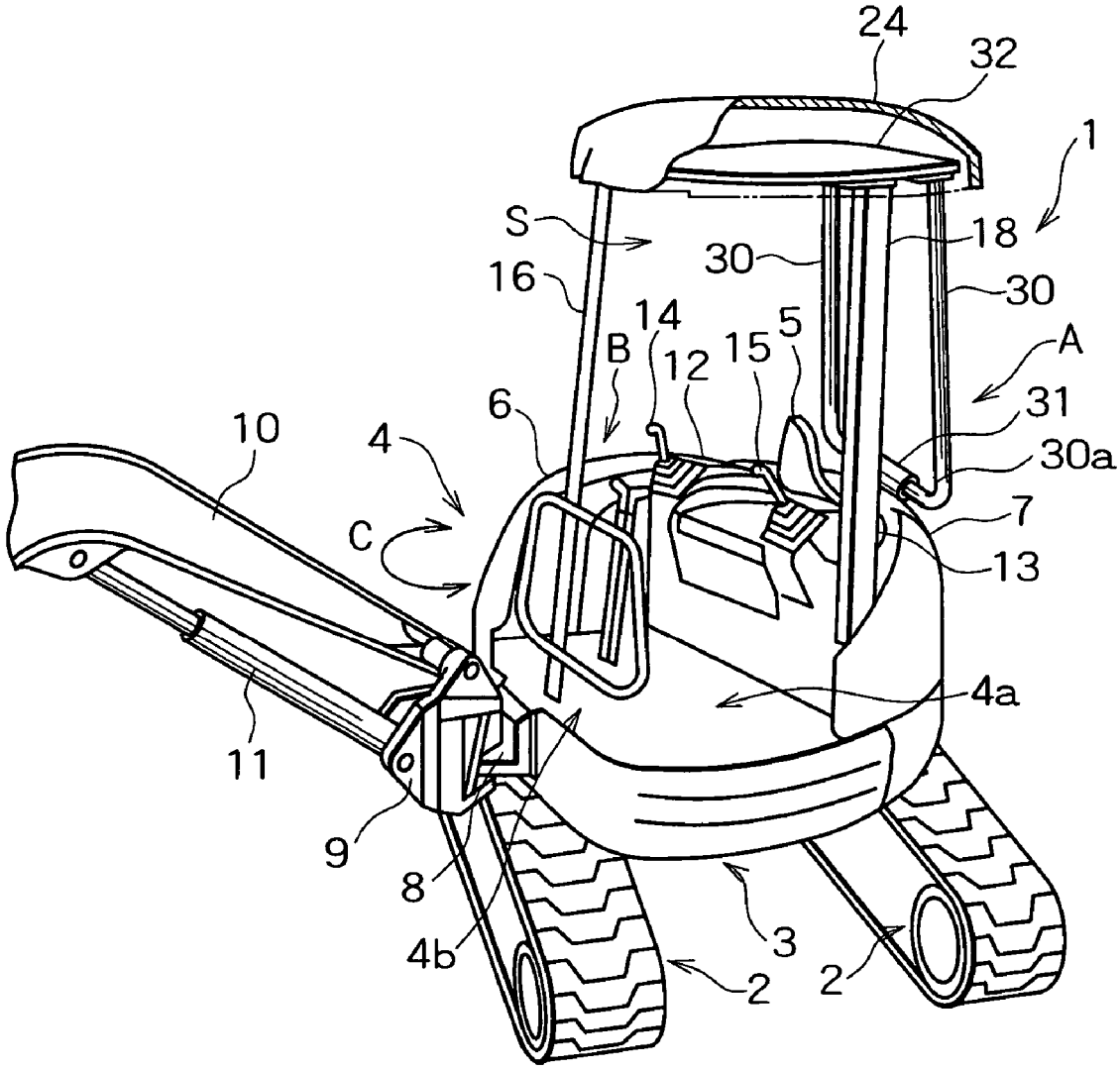
FIG. 4 is a perspective view showing a canopy structure according to a second embodiment of the present invention.

FIG. 4 illustrates a canopy structure in a construction machine according to a second embodiment of the present invention.

As to the same components as in FIG. 1, they are identified by the same reference numerals as in FIG. 1 and explanations thereof will here be omitted.

In FIG. 4, a front support post 16 and a side support post 18 are of the same constructions as in the previous first embodiment, but a pair of rear support posts 30 are provided instead of the rear support post 17 used in the first embodiment.

The pair of rear support posts 30 are each constituted by a round pipe and are interconnected at their lower ends by a connecting portion 30*a* which is disposed in the transverse direction of the machine body. As a whole, the pair of rear support posts 30 are formed in U shape.

Thus, in the present invention, the rear support post 17 may be substituted by a pair of support posts disposed vertically, whereby the strength of the canopy can be further enhanced.

The connecting portion 30*a* is fixed through a bracket 31 to a mounting stay (not shown) projecting from the engine cover 7. For illustrating the connecting portion 30*a*, a part of the rear portion of the operator's seat 5 is cut away.

Upper ends of the support posts 16, 18, and 30 are fixed to a thin metallic plate 32 and the roof 24 is fixed to the plate 32 with bolts. The plate 32 may be substituted by a pipe frame assembled in a window frame shape.

Also in this construction, a wide working sight or a wide operator's vision can be ensured because there is no support post that obstructs the left front sight of the operator.

Besides, since all the other support posts than the side support post 18 are each constituted by a round pipe smaller in section than the side support post 18, a wider working sight can be ensured. Particularly, it is possible to ensure a wide sight on the right-hand side of the operator.

In the present invention, as noted above, if the sectional area (cross-sectional area) of the front support post is set smaller than that of the rear or side support post, it is possible to ensure a wide right front sight.

The rear support posts 30 are not limited to the foregoing U-shaped construction, but may be two independent posts. Further, the number of the rear support posts is not limited to two.

In both the above embodiments, there may be provided connecting members each providing a connection between adjacent support posts so as not to cause an obstacle to an operator. In this case, there can be constituted a canopy which is more advantageous in point of strength.

In the present invention, it is preferable that the side support post be disposed on a front side with respect to the sitting portion for an operator, more particularly the waist portion of the operator sat on the operator's seat.

With this arrangement, even in the event the machine body should turn sideways, an operator can immediately put his or her hand on the side support post and hence it is possible to prevent the operator from being thrown out from the canopy.

Although the invention has been described with reference to the preferred embodiments in the attached figures, it is noted that equivalents may be employed and substitutions made herein without departing from the scope of the invention as recited in the claims.

We claim:

1. A construction machine comprising:

a lower traveling body;

an upper rotating body mounted rotatably on said lower traveling body, said upper rotating body being disposed in such a manner that a swing radius of a rear end of said upper rotating body is substantially received within the width of the lower traveling body of the construction machine;

a working attachment attached to a front portion of said upper rotating body so as to be swingable in a transverse direction of the upper rotating body;

an operator's seat disposed on one side of said upper rotating body in the transverse direction of the upper rotating body;

a devices receptacle portion disposed on the other side of said upper rotating body in the transverse direction of the upper rotating body;

an operating member for operating said working attachment, said operating member being disposed sideways of said operator's seat; and a canopy formed around said operator's seat, said canopy comprising:

a front support post disposed in front of said operator's seat;

a rear support post disposed behind said operator's seat;

a side support post disposed sideways of said operator's seat and on the side of the seat where an operator gets on and off the upper rotating body; and a roof member adapted to connect said support posts with one another to constitute a rigid body, wherein said front support post is disposed close to said devices receptacle portion and said side support post is disposed outside the said operating member in such a manner that an open portion for keeping in substantially full view of said working attachment which is swung to the operator's seat side is formed obliquely in front of said operator's seat.

2. The construction machine according to claim 1, wherein said side support post is disposed in front of an operator sitting portion of said operator's seat.

3. The construction machine according to claim 1, wherein, given that the distance between said front support post and said rear support post is La, the distance between said rear support post and said side support post is Lb, and the distance between said side support post and said front support post is Lc, said support posts are arranged so as to satisfy relations of $La<Lb$ and $La<Lc$.

4. The construction machine according to claim 1, wherein said rear support post and said side support post are each constituted by a rectangular steel pipe having a substantially rectangular section and are each disposed so that long sides of said rectangular steel pipe lie in a longitudinal direction of the upper rotating body when the seat is facing a forward vehicle direction.

5. The construction machine according to claim 1, further comprising a rear connecting member for connecting upper ends of said rear support post and said side support post with each other, and wherein said rear support post and said side support post are arranged so that said rear connecting member crosses over an operator's head.

6. The construction machine according to claim 1, further comprising a front connecting member for connecting upper ends of said rear support post and said side support post with each other, said front connecting member being forwardly generally U-shaped in a plan view.

7. The construction machine according to claim 1, wherein said front support post is constituted by a member smaller in sectional area than said rear support post or said side support post.

8. The construction machine according to claim 1, wherein said rear support post comprises a pair of support posts disposed vertically.

* * * * *